United States Patent [19]

Batson et al.

[11] Patent Number: 5,003,299

[45] Date of Patent: Mar. 26, 1991

[54] METHOD FOR BUILDING A COLOR LOOK-UP TABLE

[75] Inventors: James Batson, Sunnyvale; Ernie Beernink, Mountain View; David Fung, Cupertino; Michael Potel, Los Altos Hills; Art Cabral, Mountain View; Cary Clark, San Jose, all of Calif.

[73] Assignee: Apple Computer, Inc., Cupertino, Calif.

[21] Appl. No.: 479,982

[22] Filed: Feb. 14, 1990

Related U.S. Application Data

[62] Division of Ser. No. 195,083, May 17, 1988.

[51] Int. Cl.[5] ..... G09G 5/06

[52] U.S. Cl. ..... 340/703; 340/701

[58] Field of Search ..... 340/701, 703; 364/521

[56] References Cited

U.S. PATENT DOCUMENTS

| | | | |
|---|---|---|---|
| 4,368,463 | 1/1983 | Quilliam | 340/744 OR |
| 4,598,282 | 7/1986 | Pugsley | 340/703 OR |
| 4,799,053 | 1/1989 | Van Aken et al. | 340/703 OR |

*Primary Examiner*—Jeffery A. Brier

*Attorney, Agent, or Firm*—Blakely, Sokoloff, Taylor & Zafman

[57] ABSTRACT

A method for building an inverse color look-up table in a color graphics system. The inverse color look-up table accepts as an address input RGB color information and provides as a data output index information for indexing a color look-up table. The method initializes an array of data elements, each of said data elements for storing said index information, each of said data elements corresponding to a color position in RGB color space. A first index value is stored in the array, the first index value corresponding to an index for the color look-up table. The first index value is stored in a first of the data elements, the first data element corresponding to a color represented by the first index value in the color look-up table. An address of the first data element is also stored in a queue means. For a second of the data elements, it is determined whether the second data element has been assigned an index value. If the second data element has not been assigned an index value, second data element is assigned the first index value and an address is stored for the second data element in the queue means.

4 Claims, 6 Drawing Sheets

METHOD FOR BUILDING A COLOR LOOK-UP TABLEBACKGROUND OF THE INVENTION

This is a divisional of application Ser. No. 07/195,083 filed May 17, 1988 pending.

BACKGROUND OF THE INVENTION

1. Field of the invention

The present invention relates to the field of color displays for computer systems and, more specifically, to the field of graphical color presentation and drawing systems.

2. Prior Art

A number of methods of presentation of color information to display devices are well known in the art. In general, such display devices may be divided into two categories; red-green-blue (RGB) devices and NTSC or similar devices. In a RGB device, color information is presented to a display as three separate units of color information; a first unit of information representing the intensity of the red color gun of the display, a second unit representing the intensity of the green color gun of the display and a third unit representing the intensity of the blue color gun of the display.

NTSC devices (and their equivalents under other standards such as PAL) present color information to a display generally by phase-shifting a waveform some predetermined number of degrees from a reference signal. The color display, such as a television set interprets color based on the number of degrees the waveform is out of phase with the reference. Such systems may further control the intensity of the color by controlling the amplitude of the color signal.

The present invention relates to RGB display devices and colors systems.

In a RGB color system, a display may be controlled by presenting bits of color information to drive digital-to-analog converters which in turn produce three analog color signals which control the red, green and blue guns of a display. Typically, 24 bits of color information may be used; 8 bits representing red, 8 bits representing green and 8 bits representing blue. Using 24 bits of color information allows over 16 million ($2^{24}$) colors to be produced.

In a typical computer system employing a color display, a device called a "frame buffer" is utilized. A frame buffer is a memory for storing color information corresponding to each pixel on the display. A frame buffer may store 24 bits of information per pixel and the 24 bits of information may be used to directly control the color display. Such a system is typically termed a direct color system. However, use of a full 24 bit frame buffer required a large amount of memory space and leads to other processing in efficiencies. As an example of the amount of memory space required, many known displays, such as a display which may be utilized with the Macintosh II, have displays a comprising 640×480 pixels.

It is known to utilize a frame buffer having less than 24 bits of color information per pixel. Such a system may store for example 1, 2, 4, or 8 bits per pixel for color presentation. The bits of information from the frame buffer are used to address a color look-up table (CLUT) The data outputs of the CLUT are the RGB colors signals or their digital equivalents. The use of the CLUT offers a number of advantages. For example, a smaller amount of memory may be used for a frame buffer and colors on the display may be adjusted by adjusting the data content of the CLUT.

The present invention relates to a method in apparatus for presentation of color information to a display utilizing a color look-up table. Such a device may be termed a CLUT device.

A third method for presentation of color information to a display is commonly termed a fixed device. A fixed device, though similar to a CLUT device in featuring an index frame buffer, does not have a changeable CLUT. An example of a fixed device is the IBM Enhanced Graphics Adapter (EGA) standard.

One objective of the present invention is to develop color graphics capable of producing image-quality graphics, i.e., the ability to display a reasonable likeness of a color photograph in a microcomputer system.

A second objective of the present invention is to avoid speed and performance degradation in the computer system for users not utilizing such image quality graphics. For example, a user utilizing a word processing system has little need for high quality color graphics.

A third objective of the present invention is to allow a user to cut graphics created in a first graphic mode and paste the graphics into a display created in a second graphics mode.

These and other objectives of the present invention are described in more detail with reference to the Detailed Description of the Invention and with reference to the drawings.

SUMMARY OF THE INVENTION

The present invention relates to the field of color graphics systems for computers and has specific application in red-green-blue color systems. The present invention discloses use of a table for translating color information which may be received from an application to an index value. The index value may be stored in a frame buffer or otherwise used by the computer system. In the present invention, index values stored in the frame buffer may be used to address a color look-up table which provides color-information for a display or other device.

The present invention discloses a method for creating the color-to-index (or inverse color look-up) table which provides for seeding an array with color information from a color look-up table. Each "seed" in the array is then grown outward and data elements adjoining the seed are associated with the same color as the seed from the color look-up-table. The method of the present invention offers speed and processing efficiency advantages of methods of calculating distances between points in the array to determine assignment of colors.

Utilizing the inverse color look-up table of the present invention, color graphics may be created in one color made and displayed in a second color mode. The graphics when displayed in the second color mode will provide an approximation of the colors as originally created.

The present invention further provides method for arithmetically manipulating colors on a display.

DETAILED DESCRIPTION OF THE PRESENT INVENTION

Figure 1:
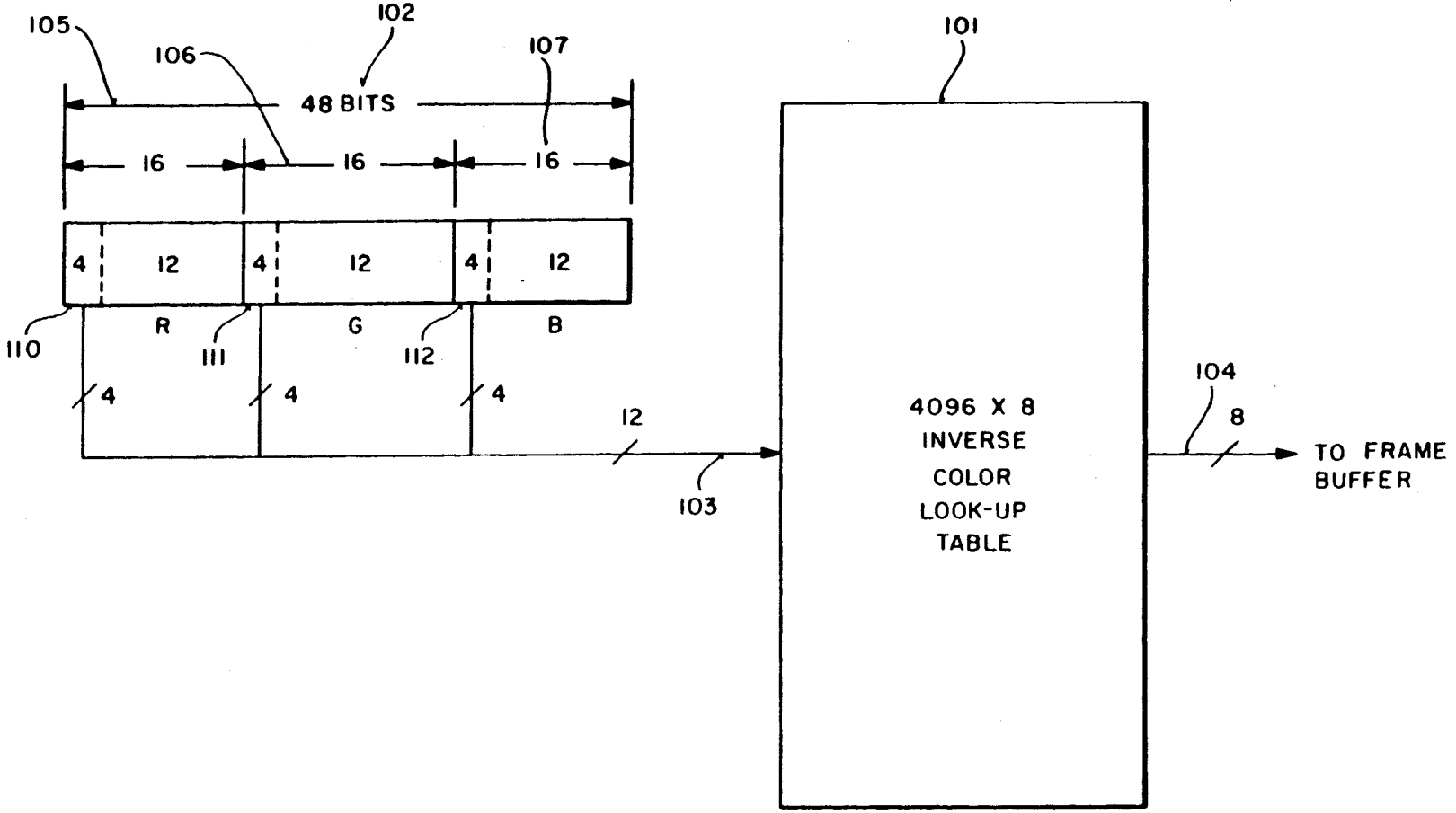
FIG. 1 is a block diagram illustrating an inverse color look-up table as may be utilized by the present invention.

A color graphics system for use with a computer is described In the following description, numerous specific details are set forth such as number of bits, etc., in order to provide a thorough understanding of the present invention. It will be obvious, however, to one skilled in the art that the present invention may be practiced without these specific details. In other instances, well known circuits, structures and techniques have not been described in detail in order not to unnecessarily obscure the present invention.

The present invention relates to color display systems for computers and is embodied in the Macintosh II Color QuickDraw system available from Apple Computer, Inc. of Cupertino, Calif., the assignee of the present invention. The present invention provides image-quality graphics in a microcomputer environment.

As one objective of the present invention, it is desired to provide such image-quality graphics while not degrading speed and performance of the computer system for users not utilizing such image-quality graphics. In meeting this objective, the present invention discloses use of hardware and software means which support a number of different color modes on a display ranging from a monochrome mode where only two colors may be displayed, to intermediate modes where 4 to 256 colors may be displayed, to a full color mode where more than 16 million colors be displayed simultaneously. In modes which support fewer colors, speed may be maximized since less memory must be manipulated. In full color mode, image-quality graphics may be achieved while having a cost tradeoff against speed. The present invention allows a user to dynamically change color modes to tailor color and speed capabilities of the system to suit the users immediate requirements.

As one important aspect of the present invention it is desired to allow a user to cut graphics created in one application and paste the graphics into another application. Typically, a user of a Macintosh system may cut graphics from a display by marking the graphics to be cut using any one of a number of methods and selecting a cut function. Alternatively, the user may mark the select and select a copy function. The copy function leaves the original display intact In either case, a copy of the graphics are kept in what is termed the users clipboard. The user may then change applications and paste the graphics from his clipboard into the new application. The present invention allows graphics which may have been created in, for example, image quality mode to be displayed in another mode such as one of the intermediate modes. The color graphics system of the present invention will display the graphics in the best approximation available utilizing the current color mode on the available output device.

As a another aspect of the present invention, it desired to provide capability for mixing of colors which are presently on a display with other colors. As examples, a user may wish to blend two colors, add two colors together or subtract one color from another color. Such function are termed arithmetic transfer modes.

INVERSE COLOR LOOK-UP TABLE

The present invention utilizes an inverse color look-up table (ICLUT) to accomplish these and other objects of the present invention. The basic structure of the ICLUT 101 is further disclosed with reference to FIG. 1. The purpose of the ICLUT 101 is to allow color information 103 to be used as address inputs to the ICLUT 101 and to provide as data outputs 104 index values to be stored in a frame buffer. The ICLUT may be considered to be a one-dimensional array of index values which correspond to RGB color input values.

In the preferred embodiment, RGB colors are specified using 48 bits of color information 102. The 48 bits of color information 102 comprise 16 bits of red color information 105, 16 bits of green color information 106 and 16 bits of blue color information 107. Within each of the red, green and blue color fields, 105, 106 and 107 respectively, the value is treated as binary fraction. The range of each value is from 0.0 to approximately 1.0, where 0.0 represents absence of the color and 1.0 represents the maximum value of the color component. The actual data in the field is the fractional part of the actual value with the leading zero implied. The fractional data is left-justified in the 16-bit field so that the most significant bit is always the highest bit of the field.

The 48-bit RGB color information field 102 may be used as an address input to an inverse color look-up table. However, in practice, use of the full 48-bit RGB color information field would require an ICLUT with an address space of $2^{48}$ entries. Such a large table is not generally desirable in computer systems as may be utilized by the present invention.

The preferred embodiment utilizes a reduced number of bits from each color channel to approximate the 48-bit RGB color information field. Specifically, in the preferred embodiment normally only four bits are used from each color channel, such as bits 110 for red, 111 for green and 112 for blue. Use of four bits for each color requires an ICLUT address space of $2^{12}$ or 4096 entries.

Since, as previously described, the color component values for red, green and blue, 105, 106 and 107, respectively, are left-justified fractions, forming of the 12-bit address input 103 to the ICLUT is a relatively simple matter of stripping the leading four bits, 110, 111 and 112 from each of the red, green and blue color fields.

The data output 104 comprises eight bits of index information to be stored in a frame buffer or otherwise utilized by the computer system The index information may be used in the conventional manner as an address input to a color look-up table (CLUT) to generate RGB signals for a display.

CONSTRUCTION OF THE INVERSE COLOR LOOK-UP TABLE

The present invention discloses methods of constructing an inverse color look-up table (ICLUT) As background to the described methods of the present invention in constructing an ICLUT, a description of RGB color space is useful. The RGB color model is based on fact that radiated color is composed of a mixture of red, green and blue light. Visible colors are the result of varying mixtures of these three primary color components. For example, mixing equal amounts of the primary colors creates white light, mixing green and red light creates yellow, absence of all components creates black, etc. Theoretically, any visible color can be represented using an RGB triple.

Figure 2:
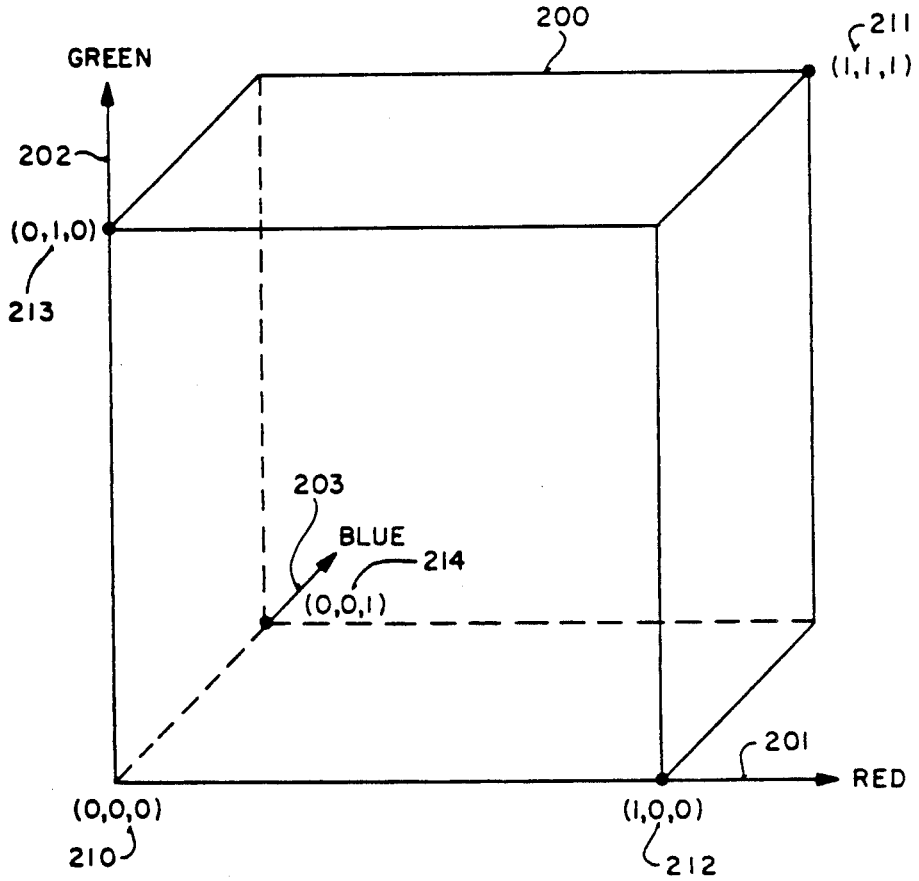
FIG. 2 is a diagram illustrating red-green-blue (RGB) color space.

As shown by FIG. 2, RGB color space can be represented as a three dimensional cube 200 with each of the colors, red, green and blue, representing one of the cube's axis, 201, 202, and 203, respectively. Any arbitrary color may be represented by a point somewhere in the cube. For example, point (0,0,0) 210 may represent lack of all color components and corresponds with the color black. Point (1,1,1) 211 represents maximum intensity of all color components and results in the color white. Points (1,0,0) 212, (0,1,0) 213, and (0,0,1) 214) represent maximum intensity of each of the three primary colors and lack of the other two color components results in the colors red, green and blue, respectively.

It is worth noting that the color model used for devices which radiate light, such those used in conjunction with the present invention, may be termed on additive color model. Other color models, such as a subtractive color model used for media which absorbs light, follow different rules and may utilize different "primary" colors. However, the present invention's methods and apparatus may be equally applicable to other color models.

In constructing an inverse color look-up table, one objective is to construct the table using as few of the computer resources as possible and to construct it as quickly as possible. In general, in computer system as may utilize the present invention, the ICLUT cannot be pre-calculated and saved in a memory device or on disk because the available system colors may be changed at any time. For example, the available system colors are changed each time the number of bits of information used to represent a pixel stored in the indexed frame buffer is changed. As previously described, the number of bits per pixel may be changed in the present invention when changing from application-to-application or at such other time as may be desired. The available system colors may also be changed when color space is being divided up in a different fashion. For example, rather than evenly distributing all colors from the RGB color space in the ICLUT, emphasis may be placed on green and various tones of green. Generally, any change to the color look-up table will require rebuilding the inverse color look-up table.

One method for building an ICLUT comprises generating each RGB permutation and calculating its distance from each color in the color look-up table. The address in the color look-up table of the color which is closest in distance from the RGB permutation is selected as the index address to be stored in the inverse color look-up table. Such a method ultimately requires a large number of calculations and substantial amounts of time.

The present invention discloses a geometrical solution to building the ICLUT which takes advantage of the three-dimensional nature of RGB space as discussed in connection with FIG. 2. Generally, the method of the present invention utilizes a three-dimensional array of elements which simulates the RGB cube of FIG. 2 and a queue of elements to operate on. In concept, the present invention may be thought of as selecting each of the colors in the color look-up table and blowing up the point in the cube represented by that space as if the point were a balloon. When the balloons representing each color in the color look-up table touch and cover all points in the cube, the points inside each balloon are assigned to the color in the color look-up table represented by the point from which the balloon originated.

Figure 3:
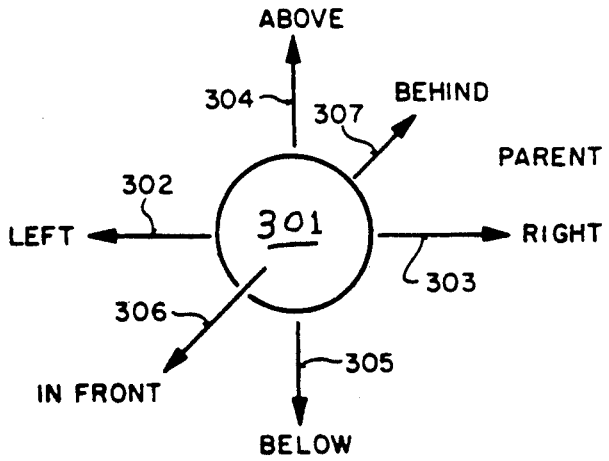
FIG. 3 is an illustration of a point in RGB space showing the point and its orientation to its neighboring points.
Figure 4:
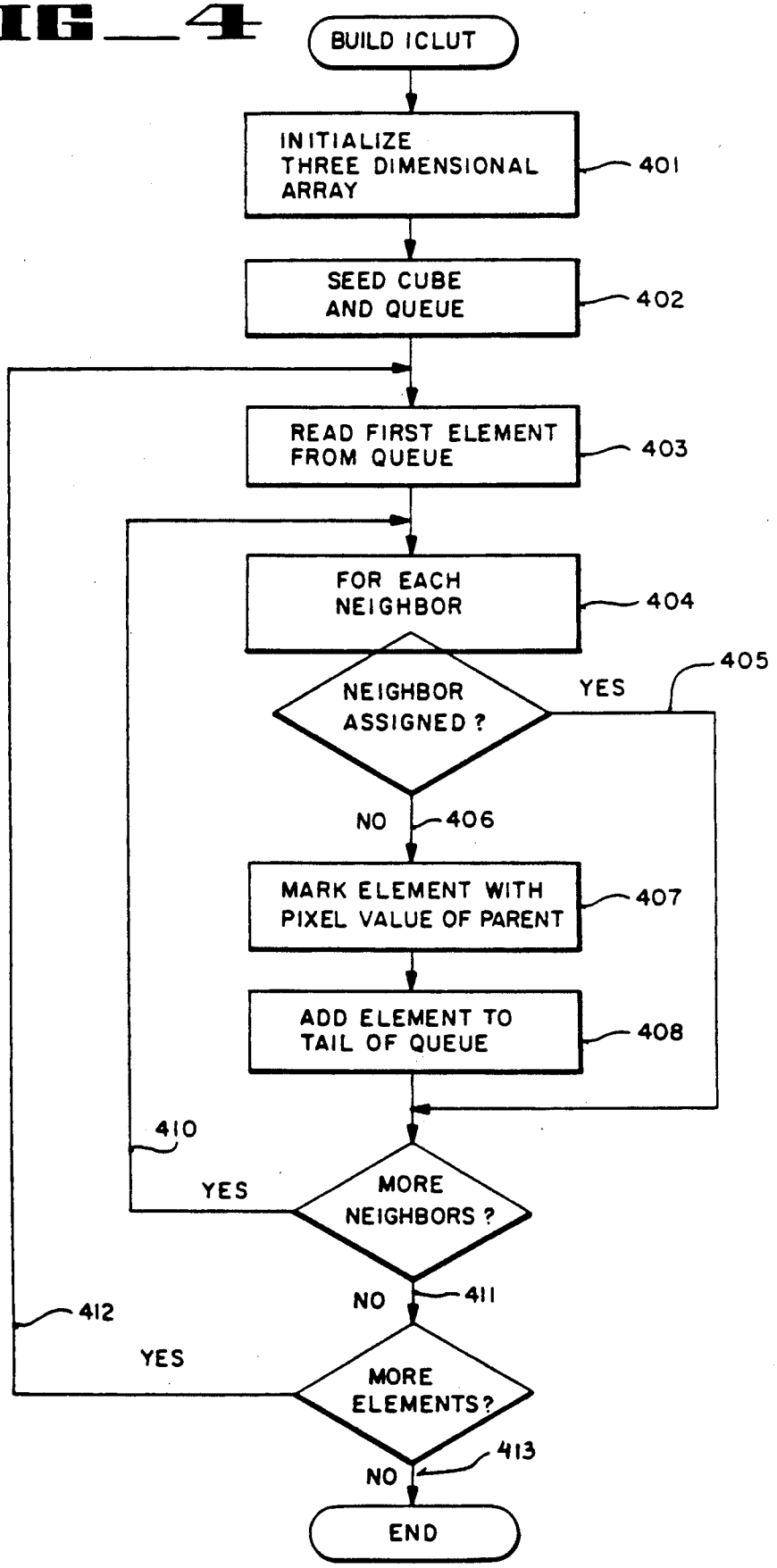
FIG. 4 is a flowchart illustrating a method of the present invention.
Figure 5:
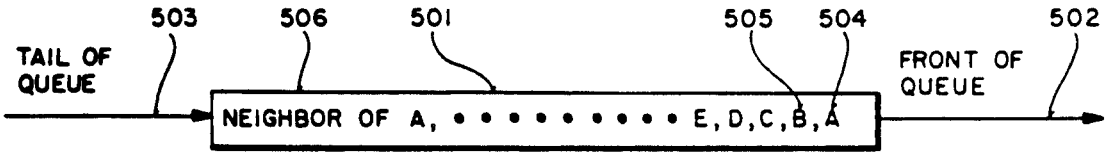
FIG. 5 is a diagram illustrating a first-in, first-out queue as may be utilized by a method of the present invention.

In operation, the method of the present invention is described in more detail with reference to FIGS. 3, 4 and 5. FIG. 4 is a flowchart describing the above-mentioned method of the present invention. The present invention initializes a three-dimensional array representing points in RGB color space to an initial value which indicates the points are not yet "owned" by a color, block 401. In addition, a "shell" is built around the cube consisting of an illegal value. The shell marks the boundaries of the cube.

The available colors from the color look-up table are "seeded" into their appropriate positions in the array, block 402. The seeding of the array comprises putting the addresses (indexes) of each element of the color look-up table into the position in the array corresponding to the RGB value represented by the data value at that address (index) in the color look-up table. The RGB value is truncated, in the preferred embodiment, to four bits representing each of the primary colors.

The addresses in the array of each of these assigned positions are added to the tail of a queue for later processing as will be described below. Referring briefly to FIG. 5, a diagram illustrating the queue 501 is illustrated. For example, address A 504 in the array may be assigned to the first color in the color look-up table. Address A is added to the tail of the queue 503. Address B 505 may then be assigned to the second color in the color look-up table and added to the tail of the queue 503. This process continues with each of the colors (C.D.E. . .) in the color look-up table.

After the array is seeded, the element at the front of the queue 505 is processed by first reading the element from the queue, block 403. This element will be termed the parent element. As illustrated in FIG. 3, the parent 301 may be thought of as having six "neighbors". The neighbors comprise the elements in the array which are logically immediately left of the parent 302, right of the parent 303, above the parent 304, below the parent 305, in front of the parent 306 and behind the parent 307.

For each neighbor, a check is first made to determine whether the neighbor is assigned, block 404. A neighbor is assigned if the value in the array has been set to an address corresponding to one of the colors in the color look-up table (and, therefore, is not still the value which the array was initialized to at block 401). If the neighbor has been assigned, branch 405, no further action is taken with the particular neighbor and processing continues with the remaining neighbors of the parent.

If the neighbor has not been assigned, branch 406, the neighbor's location in the array is marked with the same address as the parent, block 407 and the neighbor is added to the tail of the queue, block 408. Adding the neighbor to the queue is illustrated with reference again to FIG. 5 showing a neighbor of A 506 being added to the end of the queue.

Processing continues for each of the six neighbors of the parent, branch 410. After all neighbors of the parent have been processed, branch 411, the process continues for each successive element on the queue, branch 412. When the queue is empty, branch 413, all elements in the array have been assigned to a color in the color look-up table. The resulting array may be utilized as an inverse color look-up table.

While this method of constructing an inverse color look-up table offers a number of inventive advantages such as reducing the number of time-consuming calculations over methods of purely calculating and comparing distance relationships, a number of disadvantages exist. For example, the method can lead to different approximations of colors than would be found using distance calculations. The implementation of the preferred embodiment attempts to alleviate a number of these disadvantages through various methods. For example, the preferred embodiment alternates the order of selecting neighbors which prevents the queuing mechanism from favoring certain directions over others.

PRESENTATION OF COLORS IN THE PRESENT INVENTION

Figure 6:
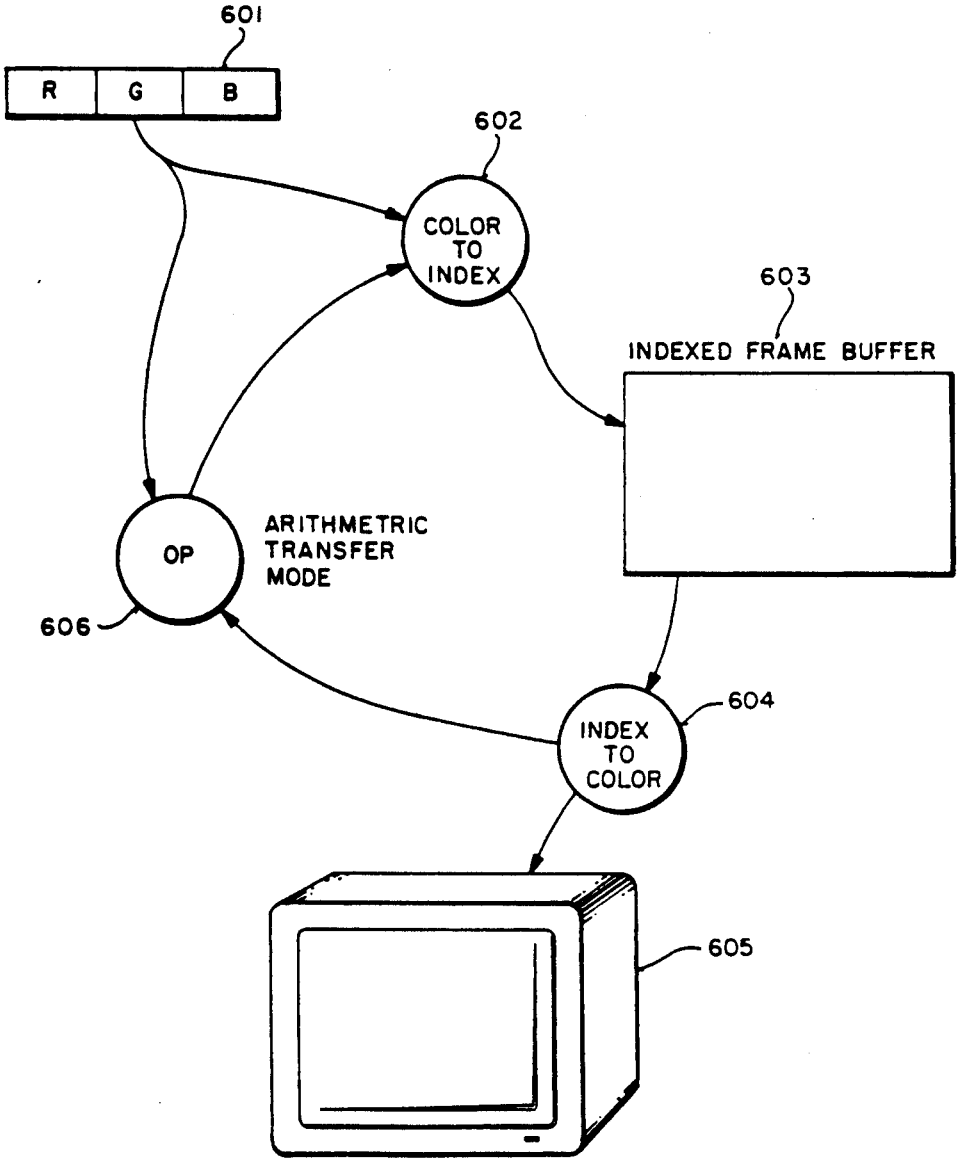
FIG. 6 is a flow diagram illustrating a method of the present invention.

Referring now to FIG. 6, a block diagram illustrating presentation of colors in the present invention shown. In general, color information may enter the system as RGB color information 601. In the preferred embodiment as discussed previously, this RGB color information 601 typically comprises 48 bits of color information, 16 bits for each of the red, green and blue components.

The RGB color information 601 is input to a process 602 for converting the color information to an index. The process 602 utilizes the inverse color look-up table using the RGB color information 601 as an input address and obtaining the index into the color look-up table as a data output. The index value in the preferred embodiment may be 1, 2, 4, or 8 bits long depending on the color mode selected by the application. A 1-bit index value allows for two colors to be presented on the display, a 2-bit value allows for four colors to be presented, a 4-bit value allows for 16 colors to be presented, an 8-bit value allows 256 colors to be simultaneously presented. It will be obvious to one of ordinary skill that a greater number of bits may be stored as an index with a corresponding increase in the number of available colors and memory usage.

The index value is stored in the index frame-buffer memory at a location corresponding to the appropriate pixel on the display.

The index value may then be used as an input to a process 604 which converts the index to a color for presentation to the display 605. The processor 604 uses as input to the color look-up table an index value from the indexed frame buffer and generates as an output 24-bit RGB color information.

HIDDEN COLOR HASH TABLE

Certain distributions of colors in the color look-up table may cause colors to be "hidden" behind other colors. This is because only the four most significant bits of each of the red, green and blue color components are used in building and addressing the ICLUT. Therefore, if two or more colors exist in the color look-up table which differ only in their 5th or greater bit, one of the colors has the tendency to hide the other colors in the inverse color look-up table. Typically, hidden colors are not an issue where colors in the color look-up table are distributed uniformly through the color space. However, when colors are not distributed uniformly, hidden colors may be significant.

The present invention utilizes a hash table of hidden colors. The hash table has one entry for each color in the color mode. Thus, if the current color mode uses 1 bit of index information in the indexed frame buffer and, therefore, has two colors, the hash table would have two entries. For example, the first color may have a red component with the first five most significant bits of 11001, green component with bits of 00011, and blue component with bits of 10001. The second color may have a red component with the first five most significant bits of 11000, green component with bits of 00010 and blue component with bits of 10000. In the example, when utilizing only the most significant four bits one of the colors would hide the other color.

The hash table of the present invention provides a list of all such hidden colors for a particular color look-up table. When attempting to determine an index for a 48-bit color, a check is made against the hash table to determine whether the color is in the list of hidden colors. If it is, an explicit distance test is performed to determine the closest match.

Figure 8:
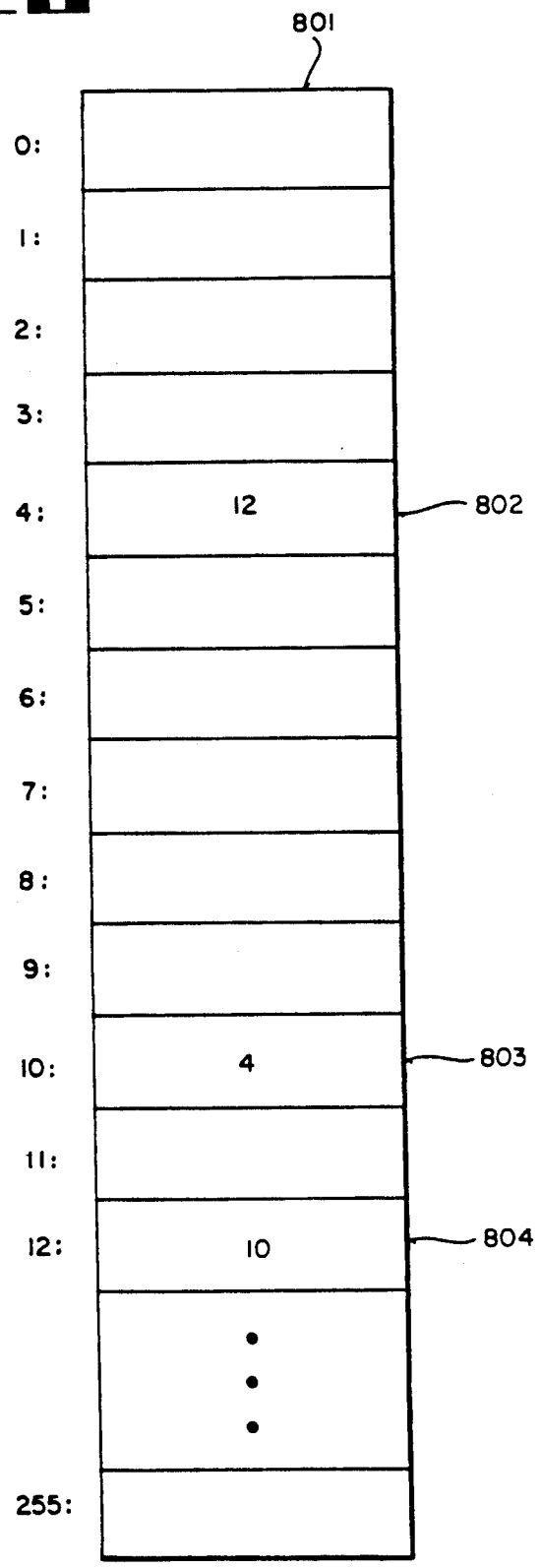

For example, referring to FIG. 8, a hash table is shown The hash table 801 has 256 entries indicating it has been built for a color look-up table with 256 entries (8-bit color mode). In the example, color 4 802 hides color 12 804, color 12 804 hides color 10 803 and color 10 803 hides color 4 802. Whenever a 48-bit color is received by the color-to-index process and an index of color 4 results, an explicit distance test is done using the 48 bits of color information to determine whether the 48 bits of color information is closer to color 4 802, color 10 803 or color 12 804. An index corresponding to the closest color 4, 10 or 12 is stored in the indexed frame buffer.

The hash table may be created when creating the inverse color look-up table. During seeding of the table, any colors from the color look-up table which, when truncated to 4-bits as in the preferred embodiment, would occupy the same data element in the array may be consider to hide one another. When such a condition is detected, an appropriate entry is made in the hash table.

ARITHMETIC TRANSFER MODES

Figure 7:
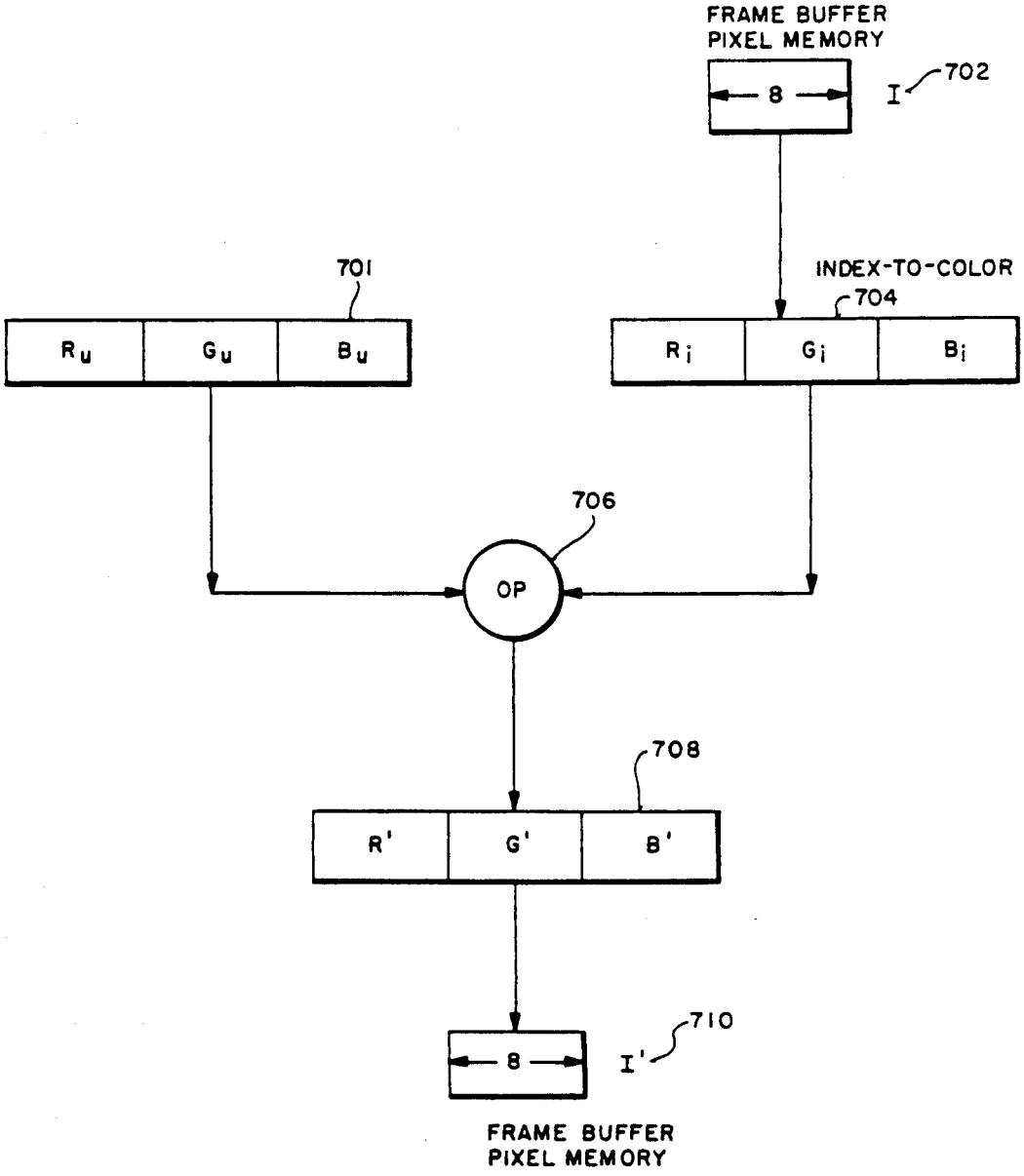
FIG. 7 is a flow diagram illustrating a method of the present invention.

As one inventive advantage of the present invention, colors on a display may be blended, added, subtracted and otherwise arithmetically manipulated. Referring to FIGS. 6 and 7, an application or user may provide RGB color information 701 for a pixel. The RGB color information 701 may be referred to as $R_uG_uB_u$. The computer system may then provide from the indexed frame buffer eight bits of index information 702 corresponding with pixel I. The eight bits of index information 702 are provided to the index to color process 604 and a RGB value 704 is obtained. The RBG color information 704 may be referred to a $R_iG_iB_i$. The color information $R_uG_uB_u$ and $R_iG_iB_i$ are used as inputs to an operation 606 and 706. The output of the operation 606 and 706 is RGB color information 708 which may be referred to as R'G'B'. The R'G'B' color information may then be used as input to the color to index process 602 and an eight bit index value I' 710 for storing in pixel memory is obtained.

The operation 606 and 706 may comprise a function such as adding the $R_uG_uB_u$ and $R_iG_iB_i$ inputs where:

$R' = R_u + R_i$;

$G' = G_u + G_i$; and $B' = B_u + B_i$.

A subtraction function may yield:

$R' = R_i - R_u$;

$G' = G_i - G_u$; and $B' = B_i - B_u$.

A blend function (blend($\infty$))may yield:

$R' = (\infty)R_i + (1-\infty)R_u$;

$G' = (\infty)G_i + (1-\infty)G_u$; and $B' = (\infty)B_i + (1-\infty)B_u$;

where $0 \leqq \infty \leqq 1$.

The arithmetic transfer mode functions are available in the present invention by utilizing the inverse color look-up table as discussed above.

Thus, an improved color graphics system for use with a computer has been described. Although the present invention has been described with specific reference to a number of details of the preferred embodiment, it will be obvious that a number of modifications and variations may be employed without departure from the scope and spirit of the present invention. Accordingly, all such variations and modifications are included within the intended scope of the invention as defined by the following claims.

We claim:

1. A method for building an inverse color look-up table in a color graphics system, said inverse color look-up table for accepting as an address input RGB color information and providing as a data output index information for indexing a color look-up table, said method comprising the steps of:

initializing an array of data elements, each of said data elements for storing said index information, each of said data elements corresponding to a color position in RGB color space;

storing a first index value in said array, said first index value corresponding to an index for said color look-up table, said first index value stored in a first of said data elements, said first data element corresponding to a color represented by said first index value in said color look-up table;

storing an address of said first data element in a queue means for later processing;

for a second of said data elements, said second of said data elements logically next to said first data element in RGB color space;

(a) determining whether said second data element has been assigned an index value;

(b) If said second data element has not been assigned an index value, assigning said second data element said first index value and storing an address for said second data element in said queue means.

2. The method as recited by claim 1, further comprising repeating steps (a) and (b) for a third, fourth, fifth, sixth and seventh data element, said second, third, fourth, fifth, sixth and seventh data elements being logically left, right, above, below, in front of and behind said first data element in said RGB color space.

3. The method as recited by claim 2, wherein an index value for each color in said color look-up table is stored in said array and said queue prior to processing said second data element.

4. The method as recited by claim 3, wherein steps (a) and (b) are repeated for each address in said queue.

* * * * *